United States Patent [19]

Krawczyk et al.

[11] Patent Number: 5,029,863

[45] Date of Patent: Jul. 9, 1991

[54] CROQUET GAME APPARATUS

[76] Inventors: Tadeusz Krawczyk; Betty M. Krawczyk, both of Rte. 54, Box 346, Loughman, Fla. 33858

[21] Appl. No.: 529,555

[22] Filed: May 29, 1990

[51] Int. Cl.[5] ..... A63F 7/00

[52] U.S. Cl. ..... 273/125 R; 273/113; 273/118 R; 273/121 R; 273/122 R; 273/123 R; 273/124 R; 273/127 R; 273/127 C

[58] Field of Search ..... 273/113, 115, 116, 118 R, 273/118 A, 119 R, 121 R, 122 R, 123 R, 124 R, 125 R, 127 R, 127 C, 56 RC, 57, 85 R, 176 F

[56] References Cited

U.S. PATENT DOCUMENTS

| | | | |
|---|---|---|---|
| 619,663 | 2/1889 | Bowie | 273/123 R |
| 1,046,125 | 12/1912 | Warren | 273/125 R |
| 1,430,838 | 10/1922 | Olson | 273/118 R |
| 1,939,819 | 12/1933 | Isazal | 273/125 R |
| 3,572,717 | 3/1971 | Anguella | 273/126 R |
| 3,841,632 | 10/1974 | Schwartz | 273/126 R |
| 3,856,313 | 12/1974 | Tierney | 273/125 R |

*Primary Examiner*—Edward M. Coven
*Assistant Examiner*—Raleigh W. Chiu
*Attorney, Agent, or Firm*—Leon Gilden

[57] ABSTRACT

Apparatus including a multi-sectioned trough like organization directing impacted croquet balls from a starting position defined by a series of aligned recesses. Guide plates direct a struck croquet ball through a medial section of the apparatus and directs such croquet ball into one of a matrix of apertures overlying a return chute. Replaceable impediments are provided in the organization to include resilient bumpers defined as semi-cylindrical arcuate members mounted upon the surface of the organization to be selectively replaced by deflector rods and or deflector plates.

3 Claims, 4 Drawing Sheets

CROQUET GAME APPARATUS

BACKGROUND OF THE INVENTION

1. Field of the Invention

The field of the invention relates to croquet game structure, and more particularly pertains to a new and improved croquet game apparatus wherein the same utilizes a readily assembled apparatus for receiving and directing impacted croquet balls directed therewithin.

2. Description of the Prior Art

Croquet as a game has been played in various formats where a relatively rigid sphere is impacted by a mallet and directed through a predetermined path. The instant invention attempts to overcome awkwardness of prior art structure by providing a compact organization readily disassembled duriing periods of non-use and thereafter readily assembled to permit accommodation of croquet balls directed therewithin providing a variety of impediments for struck croquet balls to achieve a game format within limited space providing a variety of obstacles to enhance enjoyment and chance in playing of the game. Examples of prior art structure may be found in U.S. Pat. No. 154,784 to BOGIA wherein a mallet strikes a ball and the ball is directed to a variety of cups or pockets positioned within a playing field.

U.S. Pat. No. 565,233 to SARGENT sets forth a game apparatus wherein balls are directed through a series of hoops within a container wherein the hoops or wickets are arranged to simulate croquet.

U.S. Pat. No. 721,764 to WHITE sets forth a croquet board setting forth a miniaturized version of the croquet playing field.

U.S. Pat. No. 2,103,428 to LUTES sets forth a game apparatus wherein positionable goals are mounted medially of a playing field for directing of croquet balls therewithin.

U.S. Pat. No. 2,657,056 to SORTENBERG sets forth a club arranged with a U-shaped lower face to directg croquet balls therethrough to enhance their accuracy and trajectory to a croquet wicket structure.

As such, if may be appreciated that three persists a need for a new and improved croquet game apparatus wherein the same addresses both the problems of ease of use as well as effectiveness in construction in accommdating a croquet type play within a limted space and in this respect, the present invention substantially fulfills this need.

SUMMARY OF THE INVENTION

In view of the foregoing disadvantages inherent in the known types of croquet game apparatus present in the prior art, the present invention provides a new and improved croquet game apparatus wherein the same provides a readily assembled game structure during periods of non-use that may be disassembled for storage or transport wherein the same is arranged to heighten accuracy by efficient practice of striking croquet type balls within confined forum. As such, the general purpose of the present invention, which will be described subsequently in greater detail, is to provide a new and improved croquet game apparatus which has all the advantages of the prior art croquet game apparatus and none of the disadvantages.

To attain this, the croquet game apparatus of the instant invention includes apparatus including a multisectioned trough like organization directing impacted croquet balls from a starting position defined by a series of aligned recesses. Guide plates direct a struck croquet ball through a medial section of the apparatus and directs such croquet ball into one of a matrix of apertures overlying a return chute. Replaceable impediments are provided in the organization to include resilient bumpers defined as semi-cylindrical arcuate members mounted upon the surface of the organization to be selectively replaced by deflector rods and or deflector plates.

There has thus been outlined, rather broadly, the more important features of the invention in order that the detailed description thereof that follows may be better understood, and in order that the present contribution to the art may be better appreciated. There art, of course, additional features of the invention that will be described hereinafter and which will form the subject matter of the claims appended hereto.

Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract in neither intended to define the invention of the application, which is measured by the claims, nor is it intended to be limiting as to the scope of the invention in any way.

It is therefore an object of the present invention to provide a new and improved croquet game apparatus which has all the advantages of the prior art croquet game apparatus and none of the disadvantages.

It is another object of the present invention to provide a new and improved croquet game apparatus which may be easily and efficiently manufactured and marketed.

It is a further object of the present invention to provide a new and improved croquet game apparatus which is of a durable and reliable construction.

An even further object of the present invention is to provide a new and improved croquet game apparatus which is susceptible of a low cost of manufacture with regard to both materials and labor, and which accordingly is then susceptible of low prices of sale to the consuming public, thereby making such croquet game apparatus economically available to the buying public.

Still yet another object of the present invention is to provide a new and improved croquet game apparatus which provides in the apparatuses and methods of the prior art some of the advantages thereof, while simultaneously overcoming some of the disadvantages normally associated therewith.

Still another object of the present invention is to provide a new and improved croquet game apparatus which may be compactly stored when not being utilized.

Yet another object of the present invention is to provide a new and improved croquet game apparatus wherein the same permits simulation and practice of a croquet type mallet and ball structure within a confined playing forum readily disassembled and reassembled for use.

These together with other object of the invention, along with the various features of novelty which characterize the invention, are pointed out with particularity in the claims annexed to and forming a part of this disclosure.

For a better understanding of the invention, its operating advantages and the specific objects attained by its uses, reference should be had to the accompnaying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
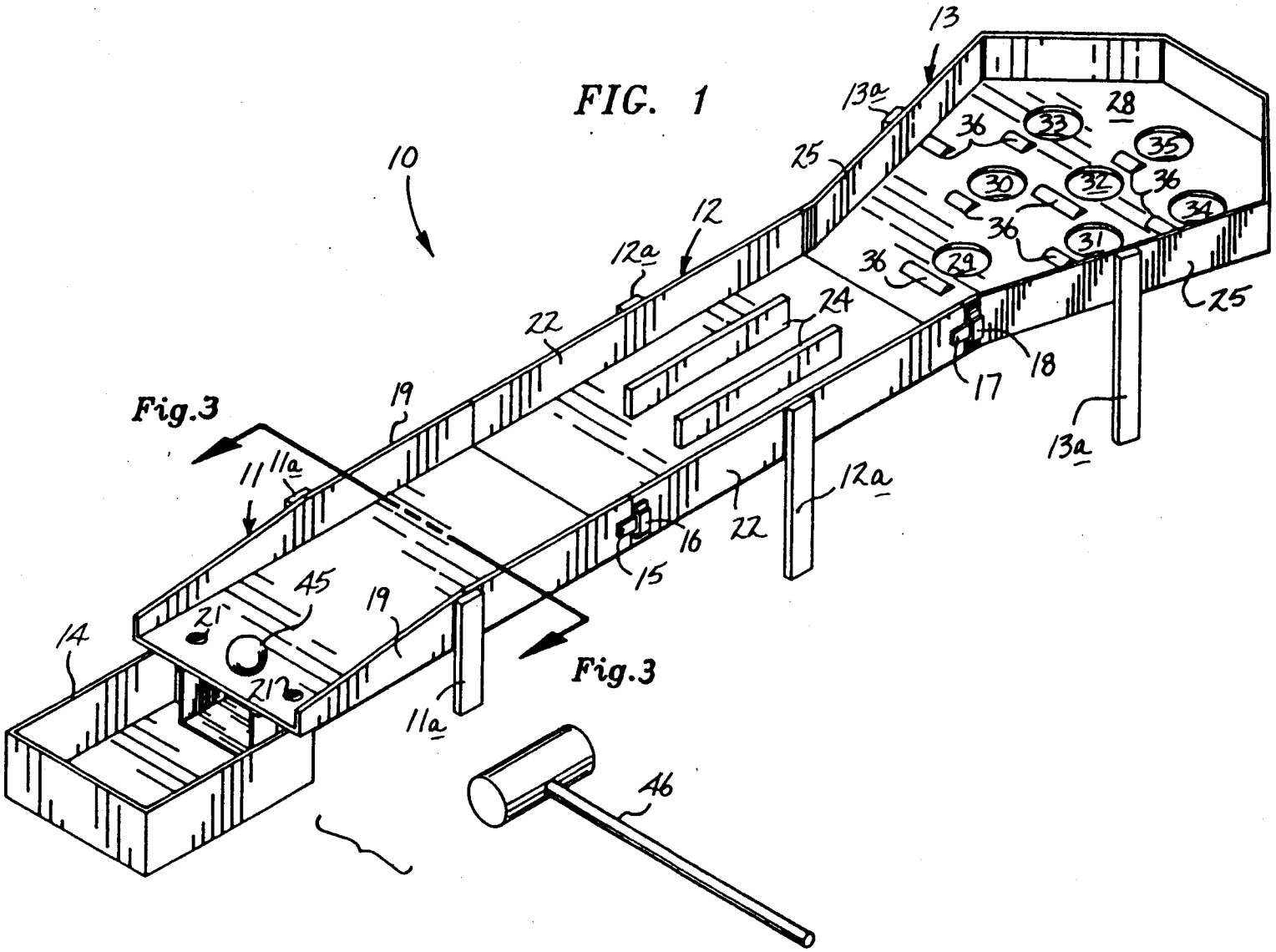
FIG. 1 is an isometric illustration of the instant invention.
Figure 2:
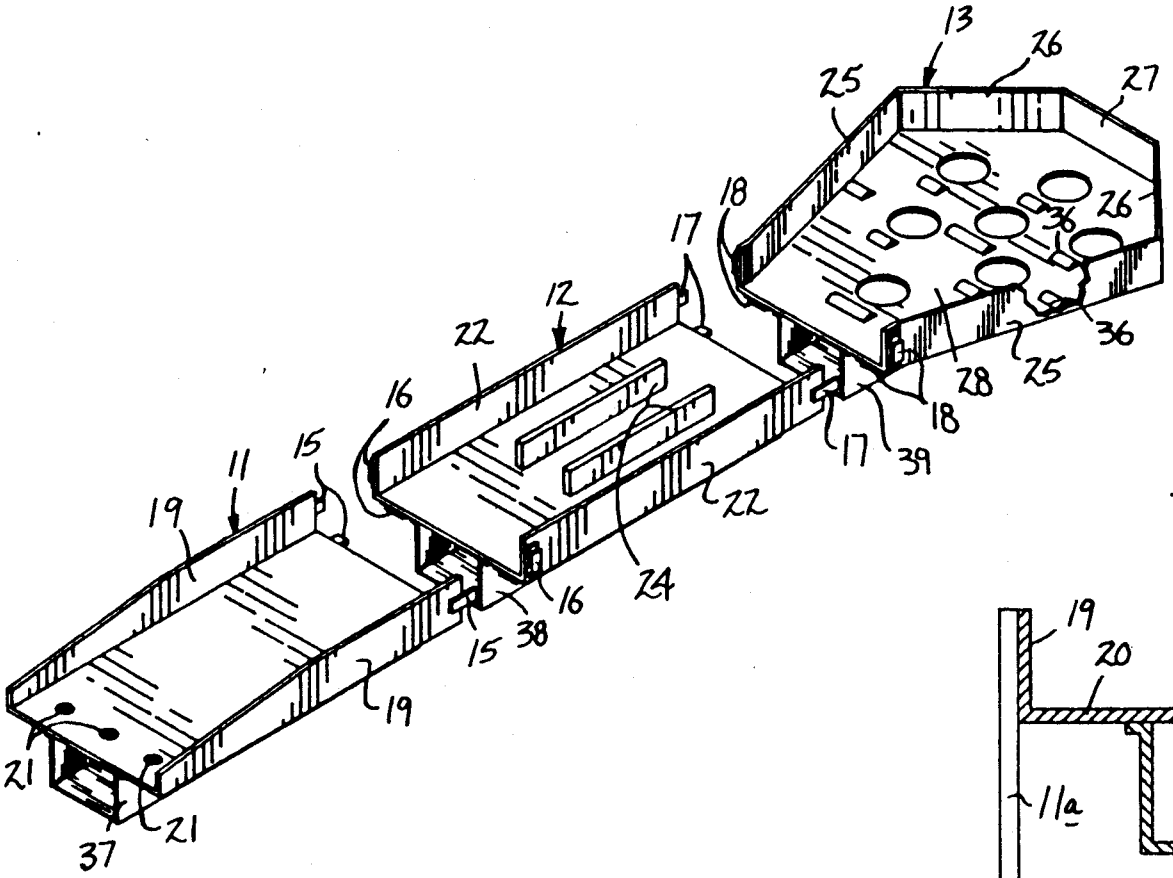
FIG. 2 is an isometric illustration of the instant invention in an exploded orientation relative to the various components of the playing field.
Figure 3:
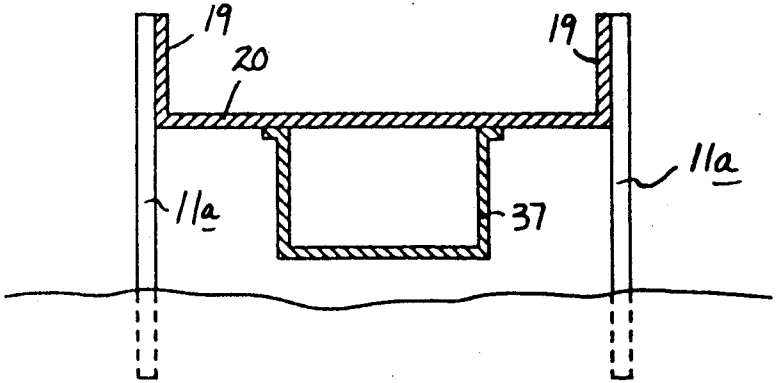
FIG. 3 is an orthographic view taken along the lines 3—3 of FIG. 1 in the direction indicated by the arrows.

With reference now to the drawings, and in particular to FIGS. 1 to 7 thereof, a new and improved croquet game apparatus embodying the principles and concepts of the present invention and generally designated by the reference numeral 10 will be described.

More specifically, the croquet game apparatus 10 of the instant invention essentially comprises a first longitudinally aligned section 11 defined as a first U-shaped trough selectively securable in longitudinal alignment with a second longitudinal section 12 defined as a second U-shaped trough that in turn is selectively secured at a forward terminal end of the second section 12 to a lower terminal end of a third section 13 arranged of a generally hexagonal configuration with a lower wall removed to provide access to the first and second sections 11 and 12 respectively. A ball return container 14 is positioned underlying a rear terminal end of the first section 11 to receive croquet balls or spheres 45 impacted by an associated mallet 46 theredirected through one of a matrix of openings defined by a first, second, third, fourth, fifth, sixth, and seventh opening 29 through 35 inclusively that are in communication with an underlying third chute 39 that is positioned in alignment with a second chute 38 underlying the second section 12 and in turn is in communication with a first chute 37 longitudinally aligned with and underlying the first section 11 to effect ball return to the container 14 upon a croquet ball or sphere 45 being directed through one of said openings 29 through 35.

The respective first, second, and third section 11, 12, and 13 are secured together utilizing a series of interlocking clips and slots. A plurality of first clips 15 are mounted in alignment with the first floor 20 of the first section 11 with a further pair of first clips 15 mounted in longitudinal alignment with the first parallel side wall 19 of the first section 11. The first clips 15 are received within respective first slots 16 and are mounted in alignment with the first clips 15 and positioned on exterior surfaces of the respective second floor 23 and the second section 12 and of the second parallel side walls 22 in the second section 12 to receive the respective floor and wall mounted clips 15 therewithin to interlock the first and second sections together. Similarly, second clips 17 are mounted extending forwardly of the second floor 23 and the second side walls 22 to be received within respective second slots 18 mounted on the exterior surface of the third floor 28 of the third section 13 and of the diverging third side walls 25. The third side walls 25 are integrally secured to fourth side walls 26 that are mounted to an end wall 27 to effect confinement of the playing surface of the organization when in an assembled configuration.

Aligned depressions 21 are positioned adjacent a rear terminal edge of the first floor 20 to receive a croquet ball 45 into one of a plurality of positions to effect directing of the croquet ball to one of the plurality of openings 29 through 35 that are arbitrarily provided with different point totals and scores. To effect guidance of the croquet balls 45 to selective areas of the third floor 28, spaced parallel guide plates 24 are equally spaced medially of the spaced parallel second side walls 22 and integrally mounted to the second floor 23 each parallel to one another and to the second side walls 22.

Figure 5:
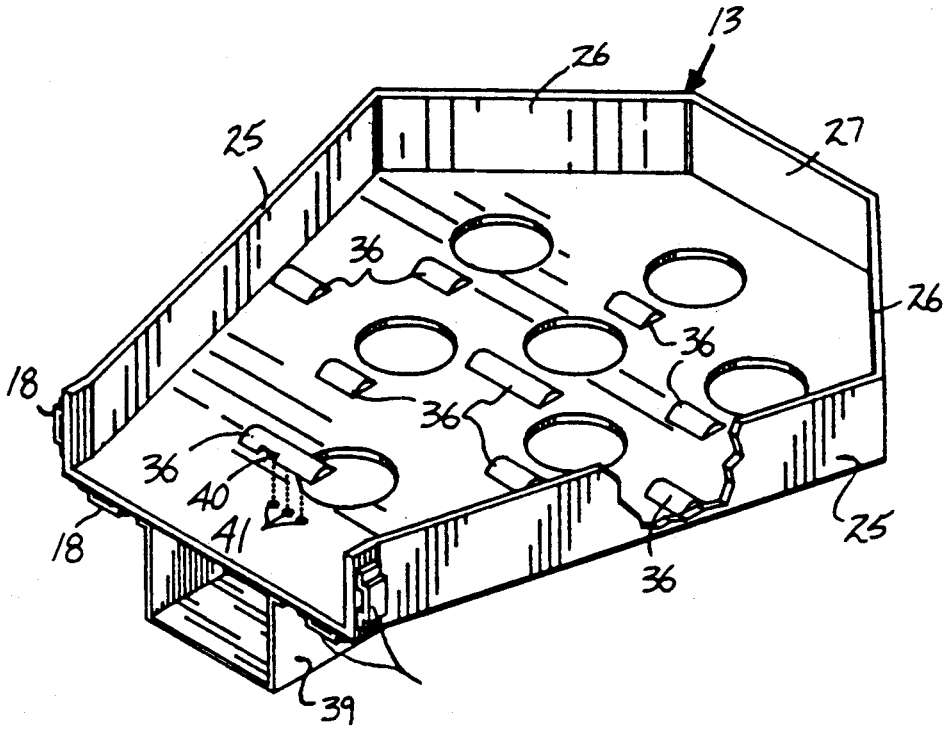
FIG. 5 is an isometric illustration of the third section of the apparatus utilizing bumper pads.
Figure 6:
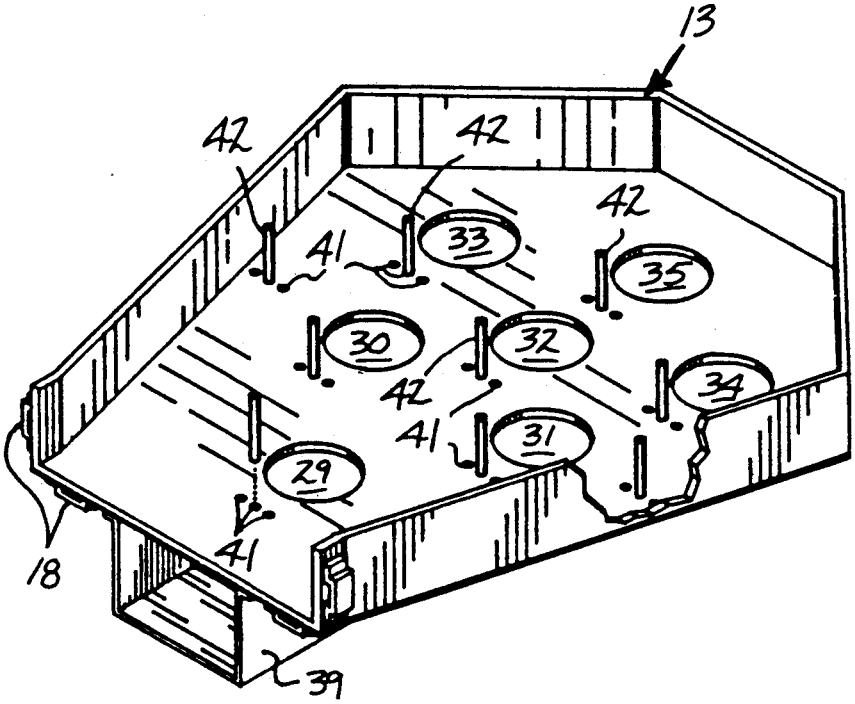
FIG. 6 is an isometric illustration of the third section of the playing field utilizing deflector rods.
Figure 7:
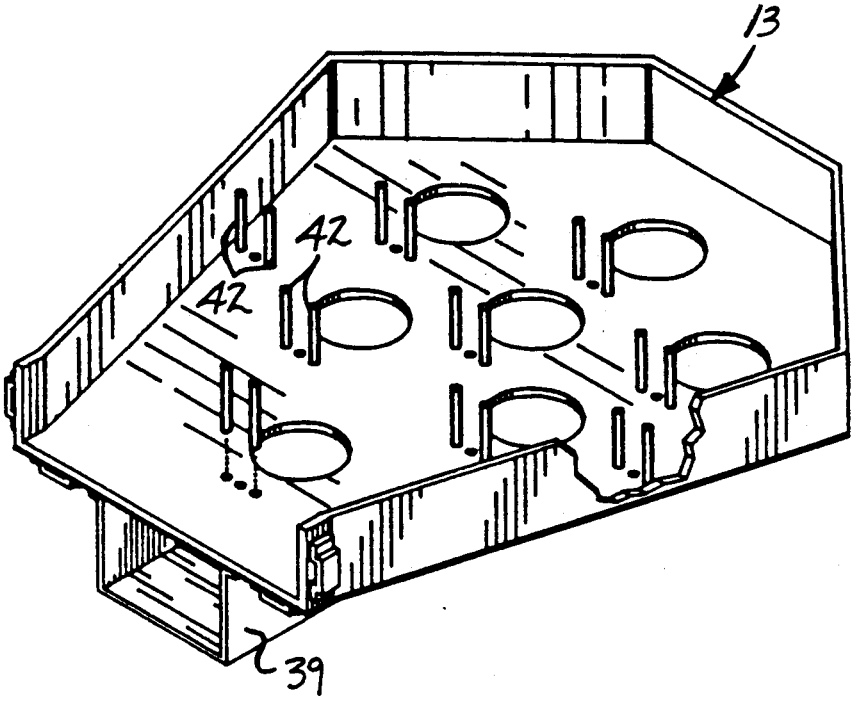
FIG. 7 is an isometric illustration of the third section of the playing field utilizing a multiple of deflector rods to enhance difficulty in playing of the game.
Figure 4:
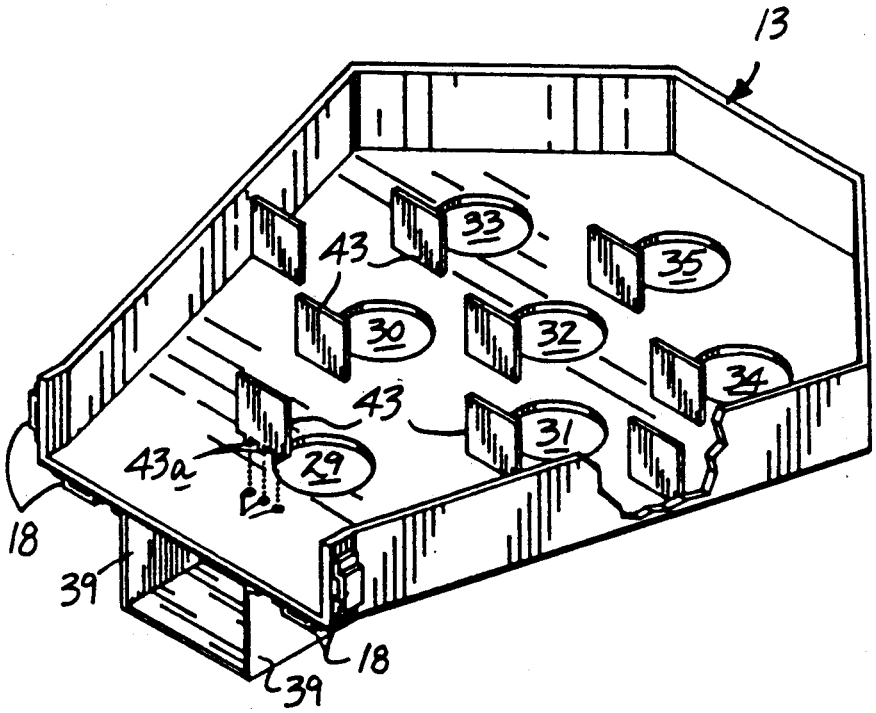
FIG. 4 is an isometric illustration of the third section of the apparatus utilizing deflector plates.

To effect difficulty in a croquet ball entering one of the openings 29 through 35, a variety of impediments are provided by the instant invention selectively utilized in cooperation with the aforenoted openings. Reference to FIG. 5 illustrates the use of resilient arcuate bumber mounds 36 positioned forwardly and aligned generally parallel to one another and positioned forwardly of each of the openings to obstruct and enhance difficulty of a croquet ball entering one of said openings. Each of the mounds includes a planar bottom surface formed with a series of aligned pegs 40. Each of the pegs are receivable within a complementarily positioned series of aligned apertures 41. The plurality of apertures 41 are positioned along each of the openings 29 through 35 as well as positioned adjacent the third side walls 25. The apertures 41 permit reception of deflector rod 42 mounted within the apertures in lieu of or in combination with the mounds 36. The deflector rods 42 are positioned to be complementarily received within the apertures as illustrated in FIG. 6 and in FIG. 7 for example for in a single or plurality of such deflector rods may be utilized positioned within each of the series of aligned apertures 41. FIG. 4 illustrates the use of deflector plates 43 formed with deflector plate pegs receivable within the apertures wherein the deflector plates are positioned to enhance difficulty and impair vision relative to observation of the positioning of the openings 29 through 35 to increase degree of difficulty in effecting positioning of a croquet ball 45 within one of the openings. Further it should be noted that the pairs of first legs 11*a*, second legs 12*a*, and third legs 13*a* are of an ever increasing length wherein the first legs are of a first length, the second legs are of a second length greater than the first length, and the third legs are of a third length greater than the second length and are selectively removable utilizing conventional fasteners or may be permanently affixed relative to the side walls of each of the sections and arranged generally orthogonally relative to the planar floor of each section to effect a tilting of the organization upwardly.

As to the manner of usage and operation of the instant invention, the same should be apparent from the above disclosure and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A game apparatus comprising in combination, a first longitudinally aligned section defined by a first "U" shaped cross sectional configuration mounted to a second longitudinally aligned section defined by a second "U" shaped cross-sectional configuration, and the second section mounted to a third section, and the first section including a first floor, the second section including a second floor, and the third section including a third floor wherein the first, second, and third floors are coextensively aligned relative to one another when the first, second, and third sections are secured together, and a rigid croquet sphere initially positionable within the first section, and the first section including a plurality of aligned depressions to selectively receive the croquet sphere therewithin, the depression positioned adjacent a free terminal end of the first floor spaced from the second floor, and a mallet provided to impact the croquet sphere, and the third section including a matrix of openings directed through the third floor, and a third chute mounted underlying the third floor in communication with the openings, and a second chute mounted underlying the second floor in communication with the third chute, and a first chute mounted underlying the first floor in communication with the second chute, a ball return container positioned adjacent the free end of the first section underlying the first chute to receive a croquet ball returned through the third, second, and first chutes, and wherein the first floor includes spaced parallel first walls, the second floor includes spaced parallel second walls, and the first walls and the first floor including clip members mounted on an exterior surface of the first walls and the first floor projecting forwardly and longitudinally thereof, and first slots mounted on an exterior surface of the second floor and the second walls in alignment with the first clip members to receive the second section, and the second section including second clip members spaced from the first section projecting exteriorly of the second floor and the second walls longitudinally aligned therewith, and second slots mounted to an exterior surface of the third floor, and spaced third walls mounted to the third floor wherein the second slots receive the second clips therewithin to selectively secure the second section to the third section, and wherein first walls include first legs of a first length, the second walls include second legs of a second length, and the third wall include third legs of a third length, wherein the third length is greater than the second length, and the second length is greater than the first length, and wherein the second floor includes a plurality of parallel guide plates, the guide plate integrally mounted to the second floor between the second walls parallel to the second walls and to each other, and wherein the openings each include a series of aligned apertures in the third floor positioned adjacent each opening between a respective opening and the second section when the second and third sections are secured together, and the apertures arranged for reception of barrier means for effecting impediment to the croquet sphere entering one of said openings, and wherein the barrier means includes a resilient arcuate mound, the arcuate mound including a planar bottom surface, the planar bottom surface including mound pegs directed below the planar surface wherein the mound pegs are receivable within each of the aligned apertures to selectively position a mound underlying an associated opening.

2. Apparatus as set forth in claim 1 wherein the barrier means further includes a plurality of deflector rods, the deflector rods selectively receivable within the aligned apertures to provide a barrier to the apertures.

3. Apparatus as set forth in claim 2 wherein the barrier means yet further includes a plurality of barrier plates, the barrier plates including plate pegs, the plate pegs selectively receivable within the aligned apertures to position a barrier plate selectively underlying an associated opening.

* * * * *